US006666617B1

(12) United States Patent
Polivka, Jr.

(10) Patent No.: US 6,666,617 B1
(45) **Date of Patent: *Dec. 23, 2003**

(54) METHOD AND APPARATUS FOR CONSTRUCTING A TEMPORARY AUTOMOTIVE VEHICLE PARKING LOT

(75) Inventor: A. Basil Polivka, Jr., Warren, OH (US)

(73) Assignee: Center West Enterprises, Niles, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/156,371

(22) Filed: May 28, 2002

(51) Int. Cl.[7] ..... E01K 3/06
(52) U.S. Cl. ..... 404/36; 404/70; 404/82
(58) Field of Search ..... 404/6, 33, 31, 404/35, 36, 70, 73, 82; 405/258.1

(56) References Cited

U.S. PATENT DOCUMENTS

| | | | | |
|---|---|---|---|---|
| 3,346,219 A | | 10/1967 | Salyer et al. | |
| 4,472,086 A | * | 9/1984 | Leach | 405/302.7 |
| 4,896,993 A | | 1/1990 | Bohnhoff | |
| 5,273,373 A | | 12/1993 | Pouyer | |
| 5,288,165 A | | 2/1994 | Douwes Dekker | |
| 5,326,192 A | | 7/1994 | Freed | |
| 5,377,447 A | | 1/1995 | Fritch | |
| 5,527,128 A | | 6/1996 | Rope et al. | |
| 5,720,135 A | | 2/1998 | Paquette | |
| 6,258,430 B1 | | 7/2001 | Perlman | |
| 6,361,245 B1 | | 3/2002 | Polivka | |
| 6,481,934 B1 | * | 11/2002 | Alexiew | 405/302.7 |

* cited by examiner

*Primary Examiner*—Thomas B. Will
*Assistant Examiner*—Raymond W Addie
(74) *Attorney, Agent, or Firm*—Tarolli, Sundheim, Covell & Tummino L.L.P.

(57) ABSTRACT

A method and apparatus for constructing a temporary automotive vehicle parking lot (10) on a land area (12) is provided. A composite drainage material (20) is provided through which water drains. The composite drainage material (20) comprises a polymeric open mesh core (22) between first and second layers (24 and 26) of a non-woven geo-textile fabric. The land area (12) is covered with the material (20) by placing rolls (28) of the material adjacent one another. The rolls (28) are unrolled over the land area (12) so that longitudinal edge portions (30 and 40) of adjacent rolls adjoin one another. A portion (34, 44) of the longitudinal edge portions (30 and 40) are overlapped and secured to each other, and not to the land area (12), to create a gapless and continuous surface (84) of the material (20), with the majority of the land area (12) lying underneath the material. The first layer (24) of each of the rolls (28) contacts the land area (12). The second layer (26) of each of the rolls (28) faces away from the land area (28) and provides the surface (84).

37 Claims, 8 Drawing Sheets

METHOD AND APPARATUS FOR CONSTRUCTING A TEMPORARY AUTOMOTIVE VEHICLE PARKING LOT

TECHNICAL FIELD

The present invention is directed to a method and apparatus for constructing a temporary automotive vehicle parking lot on a land area.

BACKGROUND OF THE INVENTION

The transportation industry often requires additional parking areas for temporary automotive vehicle storage prior to vehicle transfer and/or distribution. Such parking areas are typically needed adjacent rail yards and automotive production facilities. These additional parking areas are sometimes only needed for a relatively short period of time, such as two or three months, but can also be used for up to five years. Regardless, it is desirable to minimize the time and expenses associated with constructing the additional parking areas.

Traditionally automotive vehicle parking lots are constructed by covering a land area with concrete or asphalt. These traditional construction methods provide a desirable hard surface for automotive vehicles to be driven on, but are time-consuming and expensive. Further, covering the land area with concrete or asphalt can create complications in the project, such as having to construct a retention pond to deal with excess rain water.

Other less permanent methods for constructing automotive vehicle parking lots are also known. These other methods include covering a land area with gravel, wood chips, or shredded rubber from recycled tires. These non-traditional methods reduce the time and expenses associated with constructing the parking areas. However, these methods do not provide the desired parking surface, and can lead to the automotive vehicles being damaged. Such automotive vehicle damage can range from scratches in a vehicle's paint to extensive body damage caused by vehicles sliding into one another when excessive rain washes away the gravel, wood chips, or shredded rubber, and turns at least a portion of the parking area into a mud pit.

SUMMARY OF THE INVENTION

The present invention is a method of constructing a temporary automotive vehicle parking lot on a land area. According to the inventive method, a composite drainage material is provided through which water drains. The composite drainage material comprises a polymeric open mesh core between first and second layers of a non-woven geotextile fabric. The land area is covered with the composite drainage material by placing rolls of the composite drainage material adjacent one another to form the temporary automotive parking lot. The rolls of the composite drainage material are unrolled over the land area so that longitudinal edge portions of adjacent rolls adjoin one another. A portion of the longitudinal edge portions of the adjacent rolls are overlapped. The overlapped portions of the longitudinal edge portions of adjacent rolls are secured to each other and not to the land area to create a gapless and continuous surface of the composite drainage material with at least the majority of the land area lying underneath the composite drainage material. The first layer of each of the rolls contacts the land area. The second layer of each of the rolls faces away from the land area and provides the gapless and continuous surface on which automotive vehicles are parked. The composite drainage material directs water which contacts the second layer through the first layer, through the core between the layers, and into the land area covered by the composite drainage material.

According to one aspect of the inventive method, the step of securing the overlapped portions of the adjacent rolls comprises the steps of looping a plurality of tie members through the overlapped portions of the cores along the longitudinal edge portions of each of the adjacent rolls, and tightening the tie members to attach the cores of the adjacent rolls to each other.

According to another aspect of the inventive method, the step of securing the overlapped portions of the adjacent rolls further comprises the step of securing the second layer of the adjacent rolls to each other to form a longitudinal seam.

The present invention further provides an apparatus for constructing a temporary automotive vehicle parking lot on a land area. The apparatus comprises a composite drainage material through which water drains. The composite drainage material comprises a polymeric open mesh core disposed between first and second layers of a non-woven geo-textile fabric. The composite drainage material is adapted to cover the land area so that the land area lies underneath the composite drainage material. The first layer contacts the land area. The second layer faces away from the land area and has a surface on which automotive vehicles are parked. The composite drainage material directs water which contacts the second layer through the first and second layers, through the core between the layers, and into the land area covered by the composite drainage material. The composite drainage material is formed in rolls. Each of the rolls has longitudinal edge portions and is unrolled adjacent one another to cover the land area to form the temporary automotive parking lot. At least a portion of the adjacent longitudinal edge portions of the rolls overlaps each other. The longitudinal edge portions are secured to each other and not to the land area at the overlapping portions to form a continuous and gapless surface made of the composite drainage material.

In accordance with one aspect of the invention, the overlapped portions of the longitudinal edge portions comprise portions of the core in each of the adjacent rolls. The overlapped portions of the cores are secured together by a plurality of tie members that are looped through the overlapped portions and tightened.

In accordance with another aspect of the invention, the second layer of each of the adjacent rolls is secured to each other to form a longitudinal seam.

BRIEF DESCRIPTION OF THE DRAWINGS

The foregoing and other features of the present invention will become apparent to those skilled in the art to which the present invention relates upon reading the following description with reference to the accompanying drawings, wherein.

DESCRIPTION OF PREFERRED EMBODIMENTS

Figure 1:
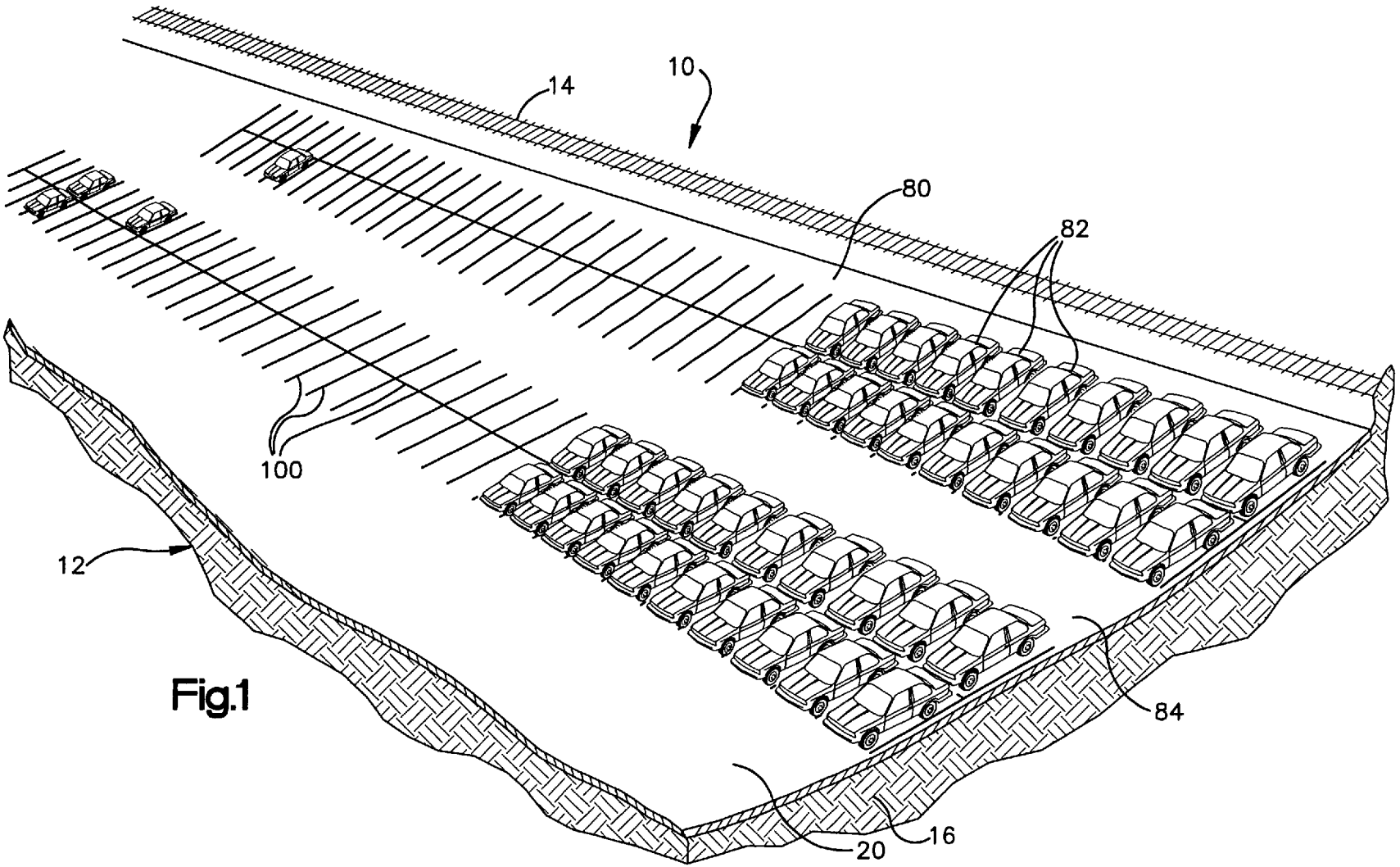
FIG. 1 is a schematic perspective view of a temporary automotive vehicle parking lot constructed in accordance with the present invention.

The present invention is directed to a method and apparatus for constructing a temporary automotive vehicle parking lot on a land area. As representative of the present invention, FIG. 1 illustrates a temporary automotive vehicle parking lot 10.

The parking lot 10 is situated on a land area 12 adjacent railroad tracks 14. The land area 12 has been cleared of any trees and large shrubbery. Thus, the land area 12 comprises soil 16 and has an upper surface 18 (FIG. 2) which may be covered by grass or other vegetation (not shown). Preferably, the land area 12 is relatively flat.

Figure 3:
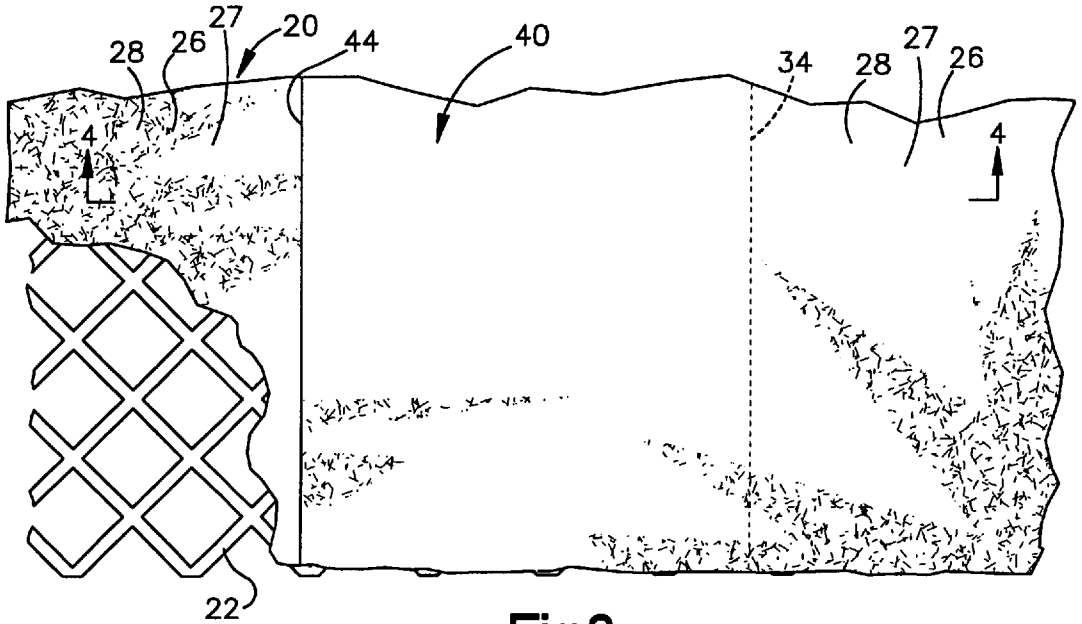
FIG. 3 is an enlarged plan view of a portion of the temporary automotive vehicle parking lot shown in FIG. 2 during construction.

A composite material 20 through which water can drain is used to construct the temporary parking lot 10 on the land area 12. The composite drainage material 20 comprises a polymeric open mesh core 22 (FIG. 3) between first and second layers 24 and 26 (FIG. 4) of a non-woven geo-textile fabric. The core 22 is 2–8 mm thick and is extruded from polyethylene resin.

The geo-textile fabric used for the first and second layers 24 and 26 is a continuous layer of a polypropylene material with an additive to help protect the fabric from the effects of ultra-violet light. The first and second layers 24 and 26 are water permeable, but are sufficiently dense to prevent solid matter, such as soil, from penetrating through the layers. Each of the first and second layers 24 and 26 is 2–8 mm thick.

The polyethylene core 22 is placed between the first and second layers 24 and 26 and the composite drainage material 20 is laminated using a heating process. The heating process fuses both the first and second layers 24 and 26 of the fabric to the core 22 to create the composite drainage material 20. While central portions 25 and 27 (constituting the vast majority) of the first and second layers 24 and 26, respectively, are fused to the core 22, along the outer periphery of the composite drainage material 20, the first and second layers are not fused to the core, as is described further below.

Figure 2:
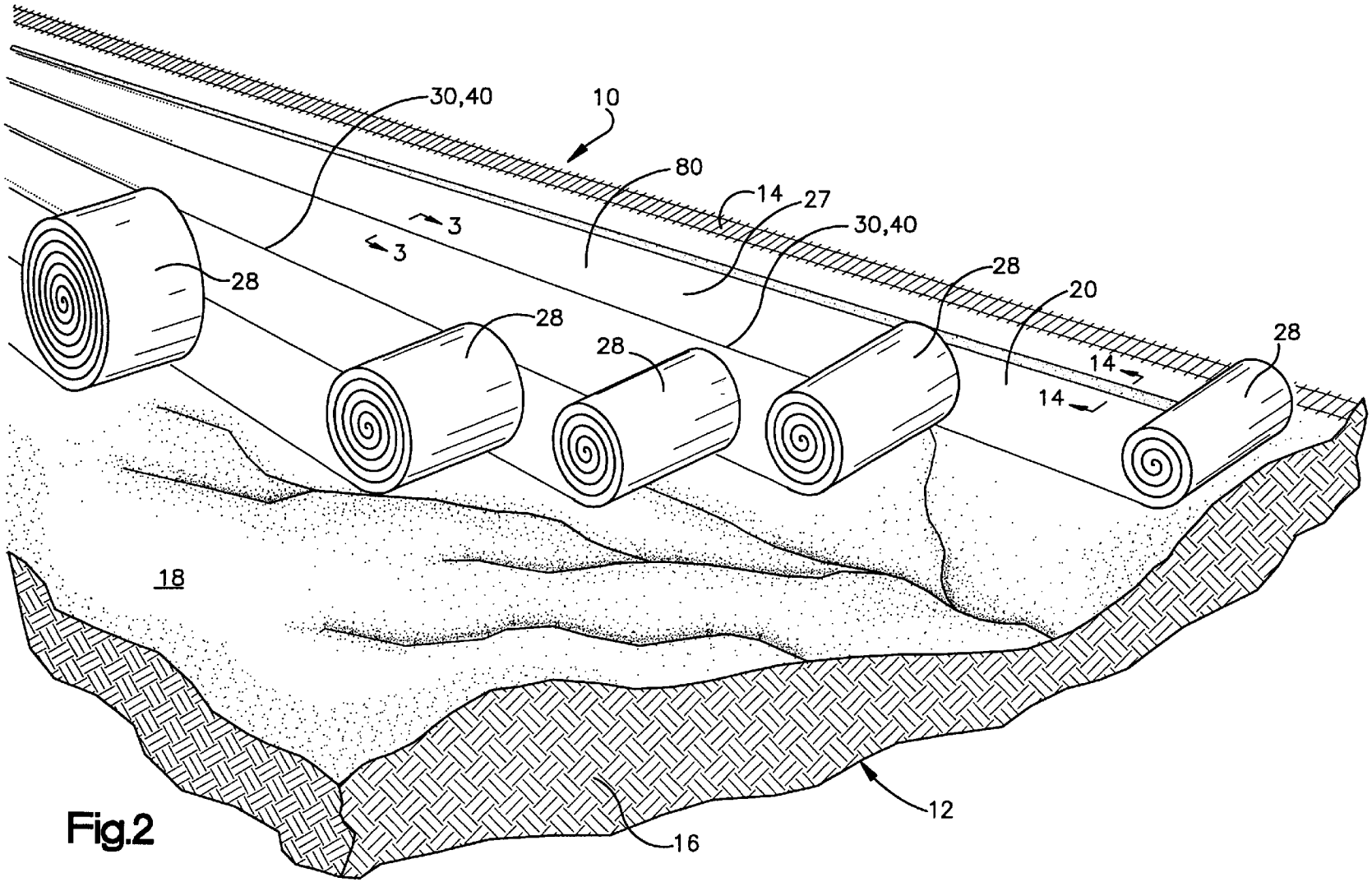
FIG. 2 is a schematic perspective view of the temporary automotive vehicle parking lot of FIG. 1 during its construction.
Figure 4:
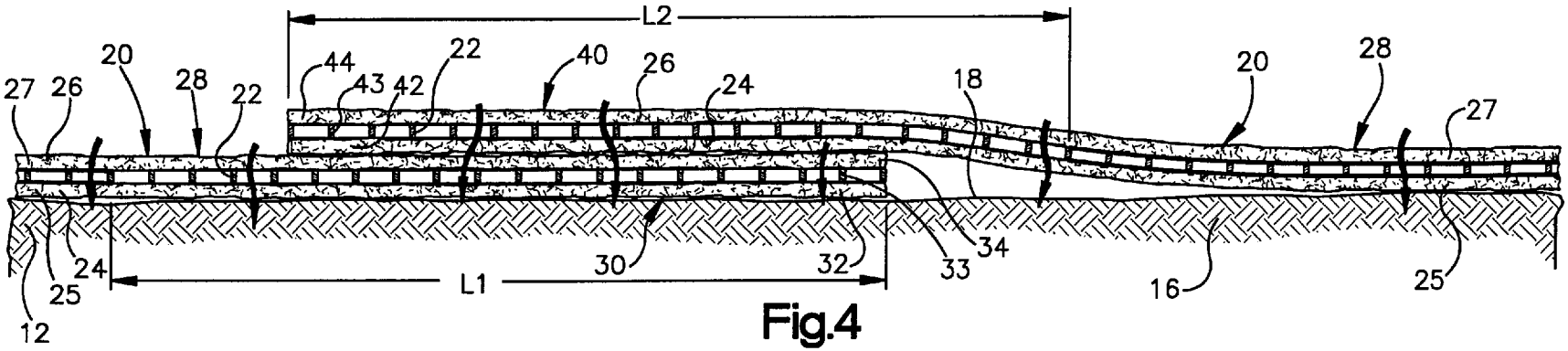
FIG. 4 is a sectional view taken along line 4—4 in FIG. 3.

The composite drainage material 20 is formed in rolls 28, as shown in FIG. 2, for ease of shipping and installation. The composite drainage material 20 may be 7 to 12 feet wide, and up to 250 feet long when unrolled. Each roll 28 of the composite drainage material 20 includes oppositely disposed first and second longitudinal edges 30 and 40 (FIG. 4).

The first longitudinal edge 30 is formed by an edge portion 32 of the first layer 24, an edge portion 33 of the core 22, and an edge portion 34 of the second layer 26. As may be seen in FIG. 4, the edge portions 32–34 are flush with one another and are not fused together. The unfused first longitudinal edge 30 extends inward for a length L1 of 6 to 10 inches to the fused central portion 27 of each roll 28.

The second longitudinal edge 40 is formed by an edge portion 42 of the first layer 24, an edge portion 43 of the core 22, and an edge portion 44 of the second layer 26. As may be seen in FIG. 4, the edge portions 42–44 are flush with one another. The unfused second longitudinal edge 40 extends inward for a length L2 of 6 to 10 inches to the fused central portions 25 and 27 of each roll 28.

To construct the temporary parking lot 10, several rolls 28 of the composite drainage material 20 are placed on the land area 12 adjacent one another. The rolls 28 of the composite drainage material 20 are then unrolled, as illustrated in FIG. 2, so that the first longitudinal edge 30 of one roll of the composite drainage material adjoins and overlaps, as described further below, the second longitudinal edge 40 of an adjacent roll of the composite drainage material. The first fabric layer 24 of each roll 28 of the composite drainage material 20 contacts the upper surface 18 of the land area 12. The second fabric layer 26 of each roll 28 faces upward, away from the land area 12, and provides a surface 80 on which automotive vehicles 82 (FIG. 1) may be parked.

Figure 5:
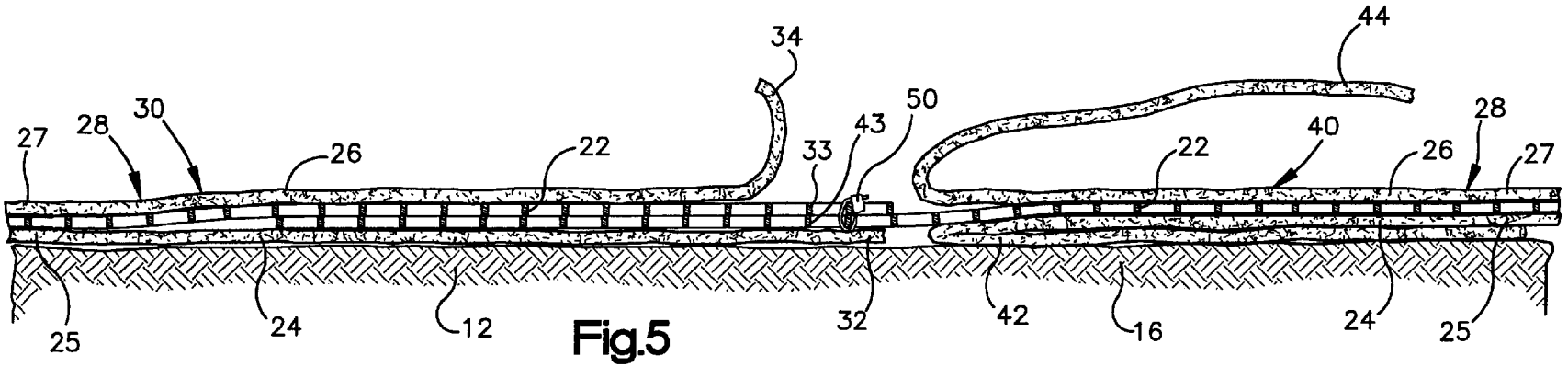
FIG. 5 is a sectional view similar to FIG. 4 illustrating a step in the construction of the temporary automotive vehicle parking lot.

As best seen in FIG. 4, the adjoining first and second longitudinal edges 30 and 40 of adjacent rolls 28 are unrolled so that the second longitudinal edge overlaps the first longitudinal edge. Next, the first and second layers 24 and 26 of the second longitudinal edge 40 are pulled back, as shown in FIG. 5, exposing the core 22. More specifically, the edge portion 42 of the first layer 24 of the second longitudinal edge 40 is folded back underneath itself over the land area 12, and the edge portion 44 of the second layer 26 of the second longitudinal edge is pulled back to expose the edge portion 43 of the core 22. The edge portion 34 of the second layer 26 of the first longitudinal edge 30 is also pulled back as shown in FIG. 5.

The edge portion 43 of the core 22 of the second longitudinal edge 40 is then inserted between the edge portion 33 of the core 22 and the edge portion 32 of the first layer 24 of the first longitudinal edge 30. As may be seen in FIG. 5, there is approximately 4 to 8 inches of overlap between the edge portions 33 and 43 of the cores 22.

Next, the edge portion 43 of the core 22 of the second longitudinal edge 40 is secured to the edge portion 33 of the core 22. The edge portions 33 and 43 of the cores 22 are secured together by looping a plurality of tie members 50, only one of which is shown in FIG. 5, through the edge portions 33 and 43 and tightening. The tie members 50 may be of any known construction and made of either a plastic or a metal. The tie members 50 are then tightened to draw the edge portions 33 and 34 together and thereby secure the longitudinal edges 30 and 40 to each other.

Figure 6:
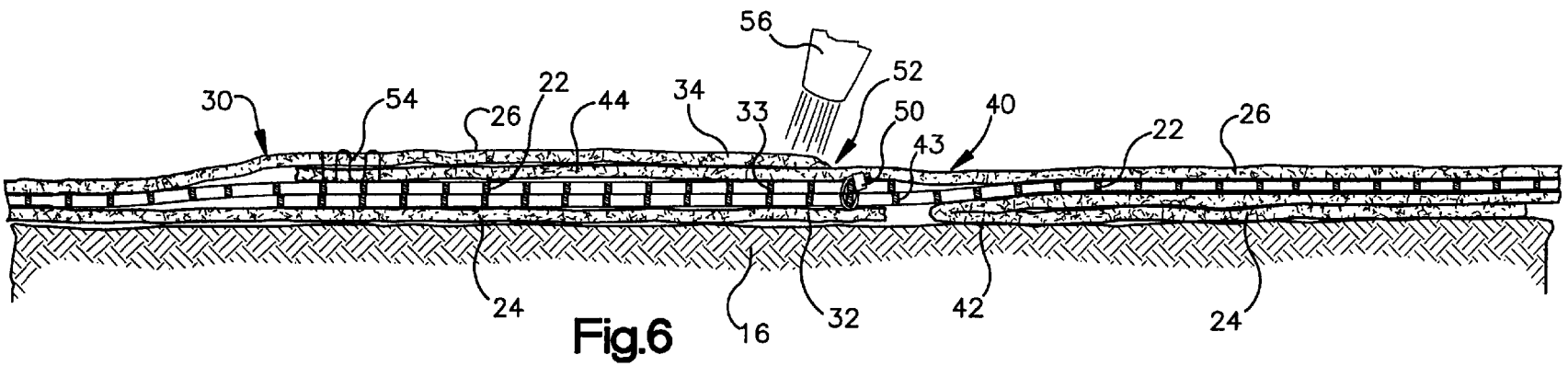
FIG. 6 is a sectional view similar to FIG. 5 illustrating another step in the construction of the temporary automotive vehicle parking lot.

The next step is to secure the second layer 26 of the two adjoining rolls 28 to each other and form a seam 52 that extends along the longitudinal edges 30 and 40. As shown in FIG. 6, the edge portion 44 of the second layer 26 along the second longitudinal edge 40 is laid down over the edge portion 33 of the core 22 of the first longitudinal edge 30. The edge portion 34 of the second layer 26 along the first longitudinal edge 30 is then unfolded and laid down on top of the edge portion 44 of the second layer 26 in an overlapping fashion.

Next, the edge portions 34 and 44 of the two second layers 26 are sewn together with stitches 54 at or near the terminal end of the edge portion 44. The stitches 54, which are shown schematically in FIG. 6, weave through the edge portions 34 and 44 of the two second layers 26 and extend along the entire longitudinal edge portions 30 and 40. The stitches 54 may be made of nylon or other suitable material and can have any known stitching pattern. Sewing of the stitches 54 is preferably done by machine.

The two second layers 26 are then heat-fused together to form the longitudinally extending seam 52. The edge portions 34 and 44 of the two second layers 26 are fused together near the terminal end of the edge portion 34 using a heat gun 56, a portion of which is shown schematically in FIG. 6. The seam 52 formed by the two second layers 26 extends along the entire longitudinal edge portions 30 and 40.

Figure 7:
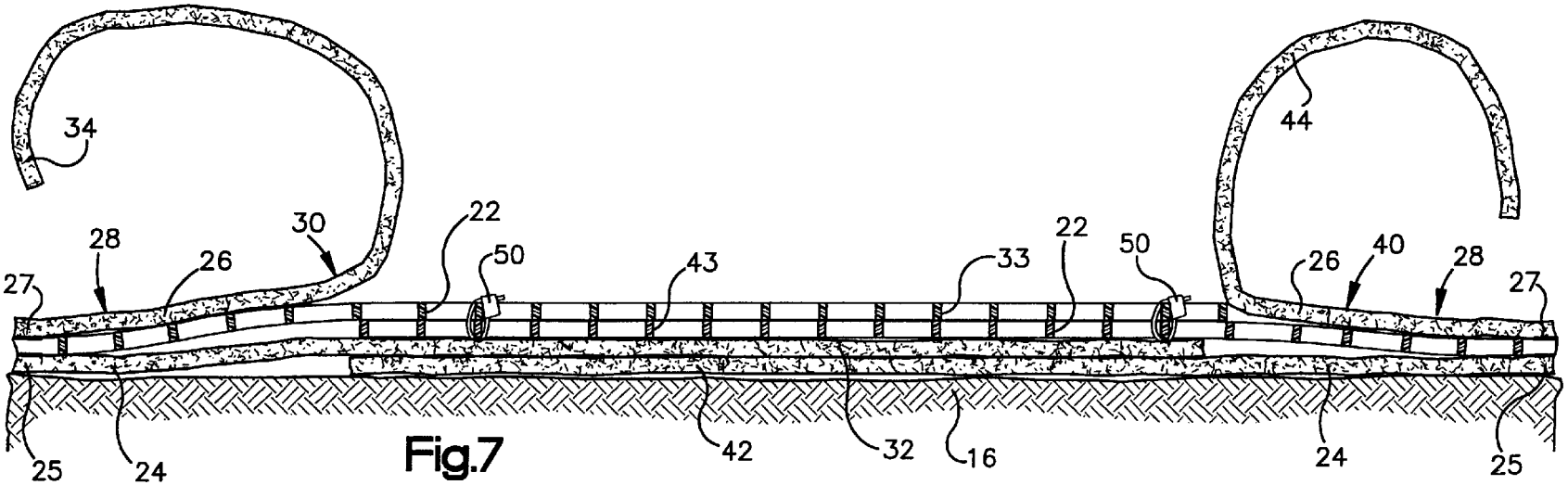
FIG. 7 is a sectional view similar to FIG. 5 illustrating a step for constructing a temporary automotive parking lot in accordance with a second method.
Figure 8:
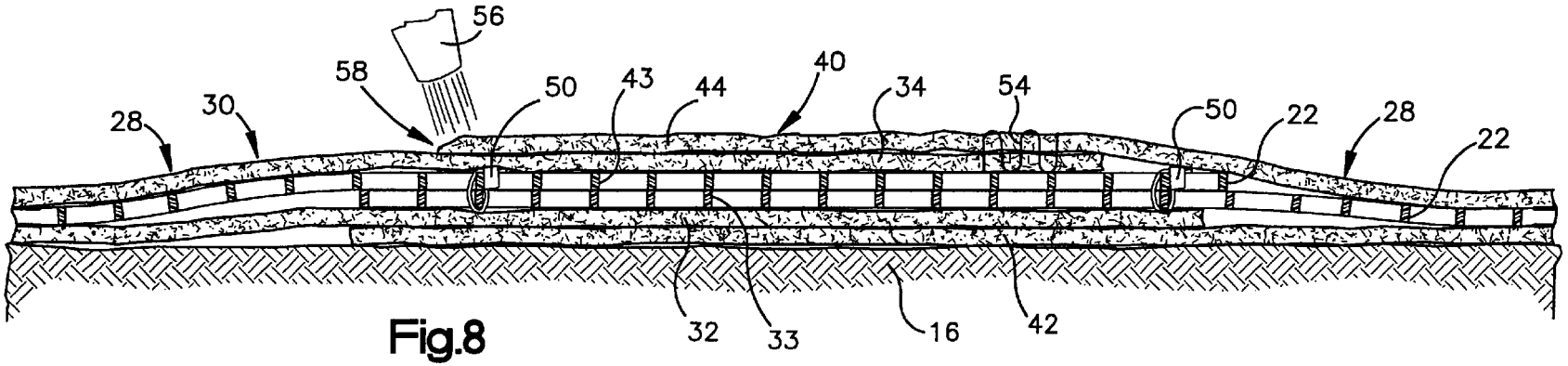
FIG. 8 is a sectional view illustrating another step for constructing the temporary automotive parking lot in accordance with the second method of FIG. 7.

A second method for joining the first and second longitudinal edges 30 and 40 of the adjacent rolls 28 is illustrated in FIGS. 7 and 8. In FIG. 7, it can be seen that the edge portion 44 of the second layer 26 of the second longitudinal edge 40 is pulled back to expose the edge portion 43 of the core 22. Similarly, the edge portion 34 of the second layer 26 of the first longitudinal edge 30 is also pulled back to expose the edge portion 33 of the core 22.

The edge portion 43 of the core 22 of the second longitudinal edge 40 is then inserted between the edge portion 33 of the core 22 and the edge portion 32 of the first layer 24 of the first longitudinal edge 30. As in the embodiment of FIGS. 1–6, there is approximately 4 to 8 inches of overlap between the edge portions 33 and 43 of the cores 22. As shown in FIG. 7, the edge portion 42 of the first layer 24 of the second longitudinal edge 40 is slid under the edge portion 32 of the first layer 24 of the first longitudinal edge 30.

Next, the edge portions 33 and 43 of the cores 22 are secured together by tie members 50, as described previously with regard to FIG. 5, through the edge portions 33 and 43. As shown in FIG. 7, there may be more than one row of the tie members 50 extending along the longitudinal edges 30 and 40 of the rolls 28.

The next step is to secure the second layer 26 of the two adjoining rolls 28 to each other and form a seam 58 that extends along the longitudinal edges 30 and 40. As shown in FIG. 8, the edge portion 34 of the second layer 26 along the first longitudinal edge 30 is laid down over the edge portion 33 of the core 22 of the first longitudinal edge 30. The edge portion 44 of the second layer 26 along the second longitudinal edge 40 is then unfolded and laid down on top of the edge portion 34 of the second layer 26 in an overlapping fashion.

The edge portions 34 and 44 of the two second layers 26 are sewn together with stitches 54 at or near the terminal end of the edge portion 34. The stitches 54, which are shown schematically in FIG. 8, weave through the edge portions 34 and 44 of the two second layers 26 and extend along the entire longitudinal edge portions 30 and 40. The stitches 54 may be made of nylon or other suitable material and can have any known stitching pattern. Sewing of the stitches 54 is preferably done by machine.

The two second layers 26 are then heat-fused together to form the longitudinally extending seam 58. The edge portions 34 and 44 of the two second layers 26 are fused together near the terminal end of the edge portion 44 using the heat gun 56, shown schematically in FIG. 8. The seam 58 formed by the two second layers 26 extends along the entire longitudinal edge portions 30 and 40.

Figure 9:
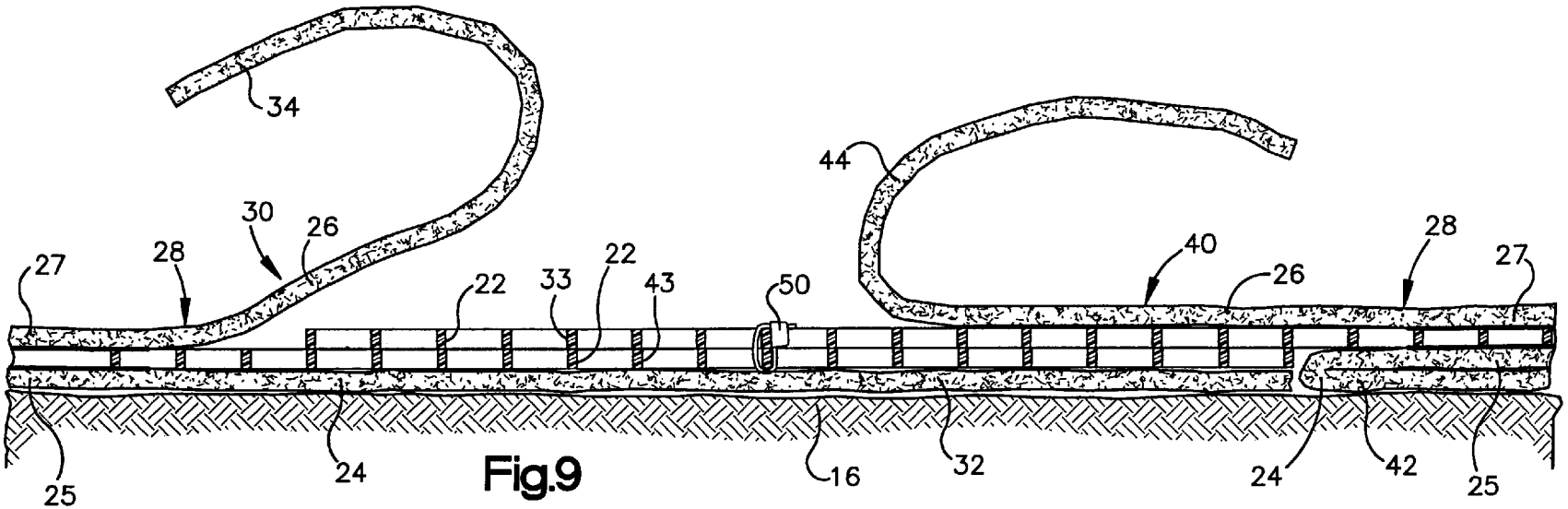
FIG. 9 is a sectional view similar to FIG. 5 illustrating a step for constructing a temporary automotive parking lot in accordance with a third method.
Figure 10:
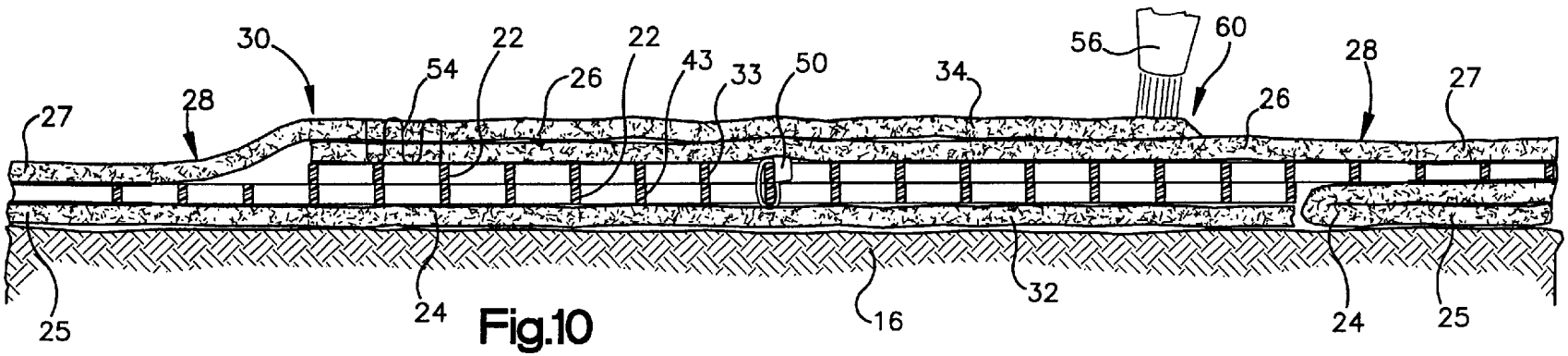
FIG. 10 is a sectional view illustrating another step for constructing the temporary automotive parking lot in accordance with the third method of FIG. 9.

A third method for joining the first and second longitudinal edges 30 and 40 of the adjacent rolls 28 is illustrated in FIGS. 9 and 10. In FIG. 9, it can be seen that the edge portion 44 of the second layer 26 of the second longitudinal edge 40 and the edge portion 42 of the first layer 24 of the second longitudinal edge are pulled back to expose the edge portion 43 of the core 22. The edge portion 34 of the second layer 26 of the first longitudinal edge 30 is also pulled back to expose the edge portion 33 of the core 22.

The edge portion 43 of the core 22 of the second longitudinal edge 40 is then placed on top of the edge portion 33 of the core 22 and the edge portion 32 of the first layer 24 of the first longitudinal edge 30. As in the embodiment of FIGS. 1–6, there is approximately 4 to 8 inches of overlap between the edge portions 33 and 43 of the cores 22. The edge portions 33 and 43 of the cores 22 are then secured together by tie members 50, as described previously with regard to FIG. 5, through the edge portions 33 and 43. It should be understood that there may be more than one row of the tie members 50 extending along the longitudinal edges 30 and 40 of the rolls 28.

The next step is to secure the second layer 26 of the two adjoining rolls 28 to each other and form a seam 60 that extends along the longitudinal edges 30 and 40. As shown in FIG. 10, the edge portion 44 of the second layer 26 along the second longitudinal edge 40 is laid down over the edge portion 33 of the core 22 of the second longitudinal edge. The edge portion 34 of the second layer 26 along the first longitudinal edge 30 is then laid down on top of the edge portion 44 of the second layer 26 in an overlapping fashion.

The edge portions 34 and 44 of the two second layers 26 are sewn together with stitches 54 at or near the terminal end of the edge portion 44. The stitches 54, which are shown schematically in FIG. 10, weave through the edge portions 34 and 44 of the two second layers 26 and extend along the entire longitudinal edge portions 30 and 40. The stitches 54 may be made of nylon or other suitable material and can have any known stitching pattern. Sewing of the stitches 54 is preferably done by machine.

The two second layers 26 are then heat-fused together to form the longitudinally extending seam 60. The edge portions 34 and 44 of the two second layers 26 are fused together near the terminal end of the edge portion 34 using the heat gun 56, shown schematically in FIG. 8. The seam 60 formed by the two second layers 26 extends along the entire longitudinal edge portions 30 and 40.

Figure 11:
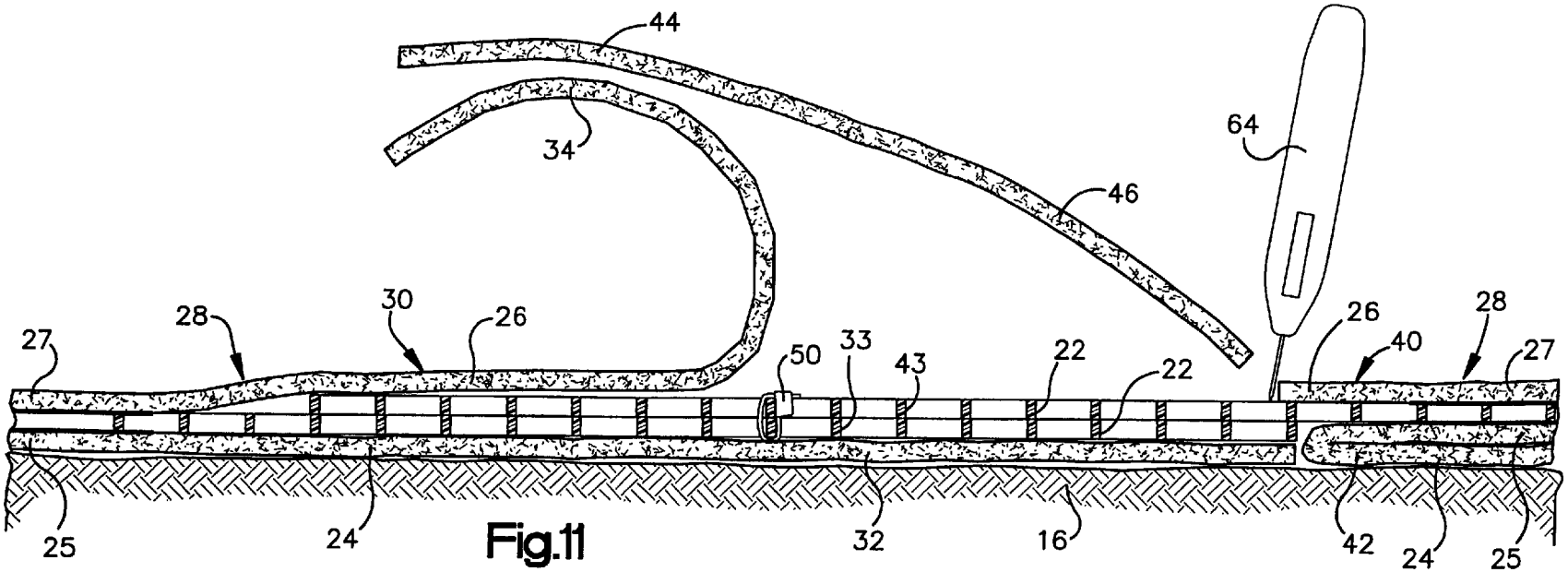
FIG. 11 is a sectional view similar to FIG. 5 illustrating a step for constructing a temporary automotive parking lot in accordance with an fourth method.
Figure 12:
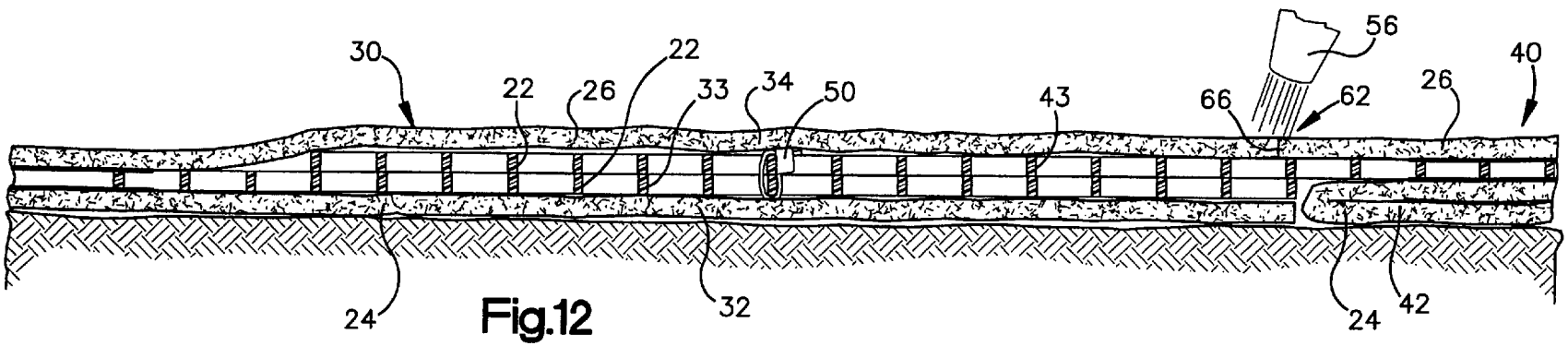
FIG. 12 is a sectional view illustrating another step for constructing the temporary automotive parking lot in accordance with the fourth method of FIG. 12.
Figure 13:
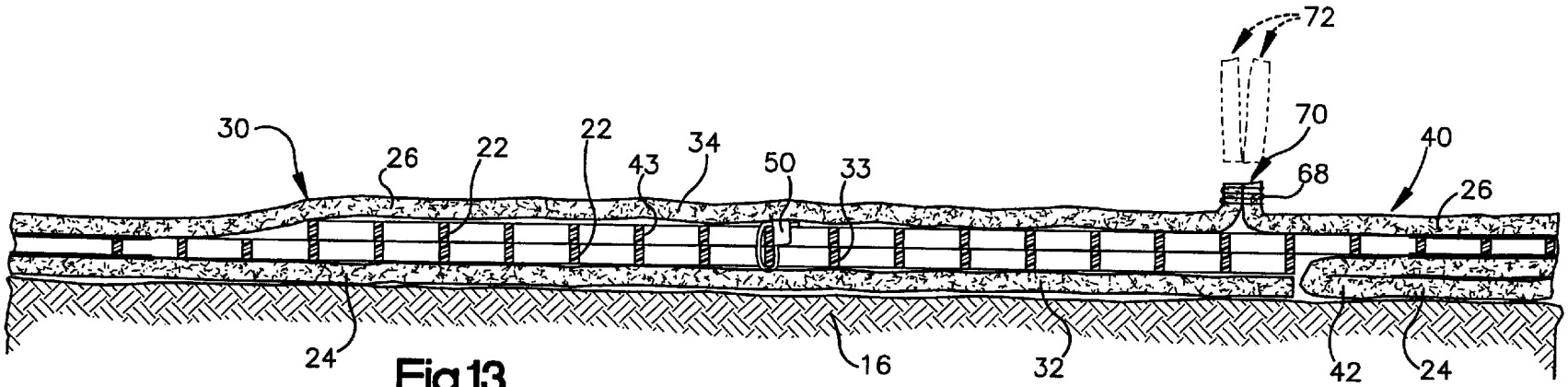
FIG. 13 is a sectional view similar to FIG. 12 illustrating an alternate step for constructing the temporary automotive vehicle parking lot in accordance with the fourth method.

Additional methods for securing the second layers 26 together along the longitudinal edges 30 and 40 and forming a seam are illustrated in FIGS. 11–13. In FIG. 11, the edge portion 44 of the second layer 26 of the second longitudinal edge 40 and the edge portion 42 of the first layer 24 of the second longitudinal edge are pulled back to expose the edge portion 43 of the core 22. The edge portion 34 of the second layer 26 of the first longitudinal edge 30 is also pulled back to expose the edge portion 33 of the core 22.

The edge portion 43 of the core 22 of the second longitudinal edge 40 is then inserted between the edge portion 33 of the core 22 and the edge portion 34 of the second layer 26 of the first longitudinal edge 30. The edge portion 43 of the core 22 overlaps the edge portion 33 of the core 22 over a distance of 4 to 8 inches.

Next, the edge portion 43 of the core 22 of the second longitudinal edge 40 is secured to the edge portion 33 of the core 22. The edge portions 33 and 43 of the cores 22 are secured together by looping a plurality of tie members 50, only one of which is shown in FIG. 11, through the edge portions 33 and 34 and tightening. The tie members 50 are then tightened to draw the edge portions 33 and 34 together and thereby secure the longitudinal edge 30 and 40 to each other.

The next step is to secure the second layer 26 of the two adjoining rolls 28 to each other and form a seam 62 that extends along the longitudinal edges 30 and 40. This may be done in a couple of different manners. One process for securing the two second layers 26 together is illustrated in FIGS. 11 and 12. As shown in FIG. 11, an end section 46 of the edge portion 44 of the second longitudinal edge 40 is trimmed off using a sharp blade or utility knife 64. The end section 46 is trimmed off at a location such that, when the edge portion 34 of the first longitudinal edge 30 is unfolded and laid down next to the now-cut edge portion 44, a butt joint 66 (FIG. 12) is created between the second layer 26 of the first longitudinal edge and the second layer 26 of the second longitudinal edge 40. The two second layers 26 are then heat-fused together along the butt joint 66 of the adjoining edge portions 34 and 44 to form the longitudinally extending seam 62.

An alternate method for securing the second layers 26 together along the longitudinal edges 30 and 40 and forming a seam is illustrated in FIG. 13. In FIG. 13, the edge portion 34 of the first longitudinal edge 30 and the edge portion 44 of the second longitudinal edge 40 are brought together in an abutting fashion. The edge portions 34 and 44 are then sewn together using stitches 68, such as the stitches previously described, to form a longitudinally. extending seam 70. Depending on their size, excess sections 72 of the edge portions 34 and 44 that extend beyond the stitching may either be trimmed off or left attached to the edge portions.

With the adjoining longitudinal edges 30 and 40 of adjacent rolls 20 secured together using either of the aforementioned methods, a continuous and gapless surface 84 of the composite drainage material 20 is created on which the automotive vehicles 80 can be parked.

Figure 14:
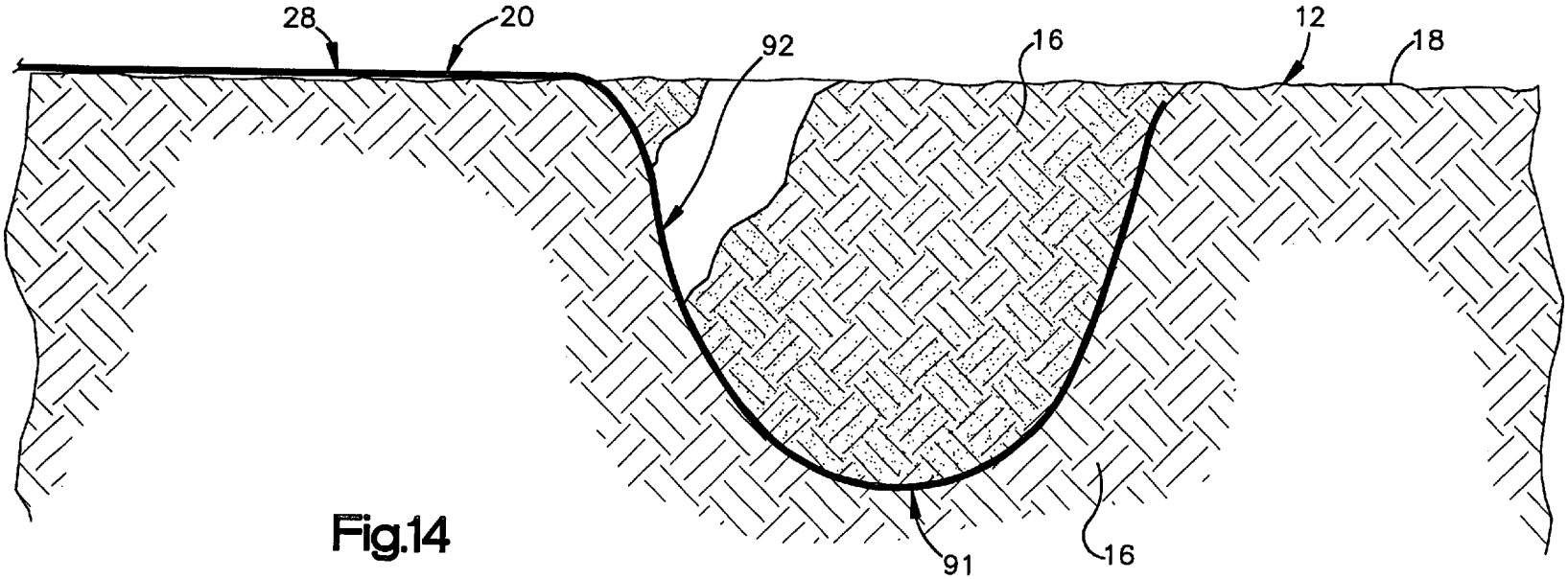
FIG. 14 is a sectional view taken along line 14—14 in FIG. 2 illustrating another aspect of the invention.

FIG. 14 is a sectional view through a portion of FIG. 2 and illustrates another step in the process for constructing the temporary automotive parking lot 10. This step comprises anchoring peripheral sections 90 of a portion of the rolls 28 that define the outer periphery of the temporary automotive parking lot 10 to the land area 12. The peripheral sections 90 are anchored by being buried in the land area 12. First, trenches 92, only one of which is shown in FIG. 14, are dug in the soil 16 underneath the peripheral sections 90. The trenches 92 are one to four feet wide and one to three feet deep. Next, the peripheral sections 90 are placed into the trenches 92, forming a lining inside each trench. Finally, the trenches 92 are filled with the soil 16 previously removed, covering over the peripheral sections 90 and thereby anchoring the peripheral sections to the land area 12.

Finally, to complete the temporary automotive parking lot 10, lines 100 (FIG. 1) are painted on the surface 80 on the second fabric layer 24 of the rolls 28 of the composite drainage material 20 to indicate a plurality of parking places for the automotive vehicles 82.

As shown by the arrows in FIGS. 6, 8, 10, and 12 the composite drainage material 20 directs water, such as rain, which contacts the surface 80 through the composite drainage material and into the soil 16 of the land area 12. The water flows through the second fabric layer 26, through the core 22, and through the first fabric layer 24. The combination of the core 22 and the fabric layers 24 and 26 function to disperse the water across a large section of the land area 12 so that normal ground water flow for the land area is maintained. This dispersion of the water obviates the need for a retention pond.

The core 22 in the composite drainage material 20 provides a sufficiently hard surface for the automotive vehicles 82 to be driven on. Further, the heat fusion of the fabric layers 24 and 26 to the core 22 allows the composite drainage material 20 to withstand vehicle traffic, including turning of vehicle wheels, without the fabric layers becoming detached from the core. The geo-textile fabric of the first and second layers 24 and 26 stabilizes the soil 14 and traps the soil underneath the composite drainage material 20 to prevent large amounts of dirt and/or mud from penetrating to the upper surface 80 of the composite drainage material. Further, the continuous and gapless surface 84 formed by the overlapping junction between the adjacent rolls 28 of the composite drainage material 20 also prevents dirt and/or mud from penetrating to the surface 80 between adjacent rolls. The composite drainage material 20 is reusable and has a useful life of up to five years. Finally, the composite drainage material 20 is relatively inexpensive to manufacture and install.

From the above description of the invention, those skilled in the art will perceive improvements, changes and modifications. For example, anchor trenches could placed in other, non-peripheral portions of the temporary automotive parking lot 10. Such improvements, changes and modifications within the skill of the art are intended to be covered by the appended claims.

Having described the invention, the following is claimed:

1. A method of constructing a temporary automotive vehicle parking lot on a land area, said method comprising the steps of:

providing a composite drainage material through which water drains, the composite drainage material comprising a polymeric open mesh core between first and second layers of a non-woven geo-textile fabric;

covering the land area with the composite drainage material by placing rolls of the composite drainage material adjacent one another to form the temporary automotive parking lot;

unrolling the rolls of the composite drainage material over the land area so that longitudinal edge portions of adjacent rolls adjoin one another;

overlapping a portion of the longitudinal edge portions of the adjacent rolls; and securing the overlapped portions of the longitudinal edge portions of adjacent rolls to each other and not to the land area to create a gapless and continuous surface of the composite drainage material with at least the majority of the land area lying underneath the composite drainage material, the first layer of each of the rolls contacting the land area, the second layer of each of the rolls facing away from the land area and providing the gapless and continuous surface on which automotive vehicles are parked;

the composite drainage material directing water which contacts the second layer through the first layer, through the core between the layers, and into the land area covered by the composite drainage material.

2. The method of claim 1 wherein said step of overlapping a portion of the longitudinal edge portions comprises overlapping a portion of the core along the longitudinal edge portions of each of the adjacent rolls.

3. The method of claim 2 wherein said step of securing the overlapped portions of the adjacent rolls comprises the steps of:

looping a plurality of tie members through the overlapped portions of the cores along the longitudinal edge portions of each of the adjacent rolls; and tightening the tie members to attach the cores of the adjacent rolls to each other.

4. The method of claim 3 wherein said step of securing the overlapped portions of the adjacent rolls further comprises the step of securing the second layer of the adjacent rolls to each other to form a longitudinal seam.

5. The method of claim 4 wherein said step of securing the second layers to each other comprises the step of heat-fusing the second layers together.

6. The method of claim 5 wherein said step of securing the second layers to each other further comprises sewing the second layers together.

7. The method of claim 4 wherein said step of securing the second layers to each other comprises the steps of:

trimming off an end section of the second layers of one of the adjacent rolls along its longitudinal edge portion so that, when the second layer of the other of the adjacent rolls is laid next to the second layer that has been trimmed, a butt joint between the second layers is created; and heat-fusing the second layers together along the butt joint.

8. The method of claim 4 wherein said step of securing the second layers to each other comprises a sewing process.

9. The method of claim 1 further comprising the step of heat-fusing a central section of each of said first and second layers to the core prior to said step of covering the land area, said step of heat-fusing the second layer to the core being sufficiently strong to withstand automotive vehicle traffic directly on the second layer including turning of automotive vehicle wheels on the second layer without the second layer becoming detached from the core, said step of heat-fusing a central section leaving the longitudinal edge portions of the first and second layers unfused to the core.

10. The method of claim 9 wherein said step of overlapping a portion of the longitudinal edge portions of the adjacent rolls includes inserting a portion of the unfused longitudinal edge portion of one of the adjacent rolls into the unfused longitudinal edge portion of another of the adjacent rolls.

11. The method of claim 10 wherein said step of inserting at least a portion of the unfused longitudinal edge portion comprises inserting a portion of the core of one adjacent roll between the core and one of the first and second layers of the other adjacent roll so that the cores of the adjacent rolls overlap each other.

12. The method of claim 11 wherein said step of securing the overlapped portions of the adjacent rolls comprises the steps of:

looping a plurality of tie members through the overlapped portions of the cores along the longitudinal edge portions of each of the adjacent rolls; and tightening the tie members to attach the cores of the adjacent rolls to each other.

13. The method of claim 12 wherein said step of securing the overlapped portions of the adjacent rolls further comprises the step of securing the second layer of the adjacent rolls to each other to form a longitudinal seam.

14. The method of claim 13 wherein said step of securing the second layers to each other comprises the step of heat-fusing the second layers together.

15. The method of claim 14 wherein said step of securing the second layers to each other further comprises sewing the second layers together.

16. The method of claim 13 wherein said step of securing the second layers to each other comprises the steps of:

trimming off an end section of the second layers of one of the adjacent rolls along its longitudinal edge portion so that, when the second layer of the other of the adjacent rolls is laid next to the second layer that has been trimmed, a butt joint between the second layers is created; and heat-fusing the second layers together along the butt joint.

17. The method of claim 13 wherein said step of securing the second layers to each other comprises a sewing process.

18. The method of claim 1 further comprising the step of painting lines on the gapless and continuous surface formed by the second layers of said composite drainage material to indicate a plurality of parking places for automotive vehicles.

19. The method of claim 1 further comprising the step of anchoring peripheral sections of a portion of the rolls of the composite drainage material that define the outer periphery of the temporary automotive parking lot to the land area.

20. The method of claim 19 wherein said step of anchoring peripheral sections to the land area comprises the steps of:

digging trenches in the land area underneath the peripheral sections;

placing the peripheral sections into the trenches so that the peripheral sections form a lining inside the trenches; and filling the trenches lined by the peripheral sections with material previously removed during said step of digging to thereby anchor the peripheral sections to the land area.

21. Apparatus for constructing a temporary automotive vehicle parking lot on a land area, said apparatus comprising:

a composite drainage material through which water drains, said composite drainage material comprising a polymeric open mesh core disposed between first and second layers of a non-woven geo-textile fabric;

said composite drainage material being adapted to cover the land area so that the land area lies underneath said composite drainage material, said first layer contacting the land area, said second layer facing away from the land area and having a surface on which automotive vehicles are parked;

said composite drainage material directing water which contacts said second layer through said first and second layers, through said core between said layers, and into the land area covered by said composite drainage material;

said composite drainage material being formed in rolls, each of said rolls having longitudinal edge portions and being unrolled adjacent one another to cover the land area to form the temporary automotive parking lot;

at least a portion of said adjacent longitudinal edge portions of said rolls overlapping each other, said longitudinal edge portions being secured to each other and not to the land area at said overlapping portions to form a continuous and gapless surface made of said composite drainage material.

22. The apparatus of claim 21 wherein said overlapped portions of said longitudinal edge portions comprise portions of said core in each of said adjacent rolls.

23. The apparatus of claim 22 wherein said overlapped portions of said cores are secured together by a plurality of tie members that are looped through said overlapped portions and tightened.

24. The apparatus of claim 23 wherein said second layers of said adjacent rolls are secured together by stitches.

25. The apparatus of claim 24 wherein said second layers of said adjacent rolls are further secured together by heat-fusing said second layers to form a longitudinal seam.

26. The apparatus of claim 23 wherein said second layer of each of said adjacent rolls is secured to each other to form a longitudinal seam.

27. The apparatus of claim 26 wherein said longitudinal seam is formed by sewing said second layers together.

28. The apparatus of claim 20 wherein said longitudinal seam comprises a butt joint between said second layers, said second layers being held together along said longitudinal seam by heat-fusing said second layers together.

29. The apparatus of claim 21 wherein said second layer of said composite drainage material includes lines which are painted on said continuous and gapless surface to indicate a plurality of parking places for automotive vehicles.

30. The apparatus of claim 21 wherein a central section of said first and second layers of said composite drainage material are heat-fused to opposite sides of said core, said core being secured to said second layer sufficient to withstand automotive vehicle traffic directly on said second layer including turning of automotive vehicle wheels on said second layer without said second layer becoming detached from said core, said first and second layers at said longitudinal edge portions remaining unfused to said core.

31. The apparatus of claim 30 wherein said overlapped portions of said longitudinal edge portions comprises a portion of said core of one of said rolls that is inserted between said core and one of said first and second layers of an adjacent one of said rolls.

32. The apparatus of claim 31 wherein said overlapped portions of said cores are secured together by a plurality of tie members that are looped through said overlapped portions and tightened.

33. The apparatus of claim 32 wherein said second layers of said adjacent rolls are secured together by stitches.

34. The apparatus of claim 33 wherein said second layers of said adjacent rolls are further secured together by heat-fusing said second layers to form a longitudinal seam.

35. The apparatus of claim 32 wherein said second layer of each of said adjacent rolls is secured to each other to form a longitudinal seam.

36. The apparatus of claim 35 wherein said longitudinal seam is formed by sewing said second layers together.

37. The apparatus of claim 36 wherein said longitudinal seam comprises a butt joint between said second layers, said second layers being held together along said longitudinal seam by heat-fusing said second layers together.

* * * * *